US006001521A

United States Patent [19]

Hashizume et al.

[11] Patent Number: 6,001,521

[45] Date of Patent: Dec. 14, 1999

[54] ELECTROPHOTOGRAPHIC PHOTOSENSITIVE MEMBER

[75] Inventors: Junichiro Hashizume; Shigenori Ueda, both of Nara; Makoto Aoki, Joyo, all of Japan

[73] Assignee: Canon Kabushiki Kaisha, Tokyo, Japan

[21] Appl. No.: 09/178,884

[22] Filed: Oct. 27, 1998

[30] Foreign Application Priority Data

Oct. 29, 1997 [JP] Japan ..... 9-312596
Oct. 29, 1997 [JP] Japan ..... 9-312598

[51] Int. Cl.[6] ..... G03G 5/047; G03G 5/147

[52] U.S. Cl. ..... 430/58.1; 430/59.1; 430/67

[58] Field of Search ..... 430/58, 67

[56] References Cited

U.S. PATENT DOCUMENTS 5,262,262 11/1993 Yagi et al. ..... 430/67
5,536,610 7/1996 Ojima et al. ..... 430/67
5,623,716 4/1997 Masaki et al. ..... 399/159
5,849,446 12/1998 Hashizume et al. ..... 430/67

FOREIGN PATENT DOCUMENTS 57-115551 7/1982 Japan .
60-186849 9/1985 Japan .
61-219961 9/1986 Japan .
6-317920 11/1994 Japan .

*Primary Examiner*—Roland Martin
*Attorney, Agent, or Firm*—Fitzpatrick, Cella, Harper & Scinto

[57] ABSTRACT

For providing an electrophotographic photosensitive member that can always maintain good images without occurrence of fusion of toner, independent of the circumstances and the combination of urging pressure of a cleaner, process speed, components contained in toner, etc. and that can always maintain good images of high resolution and even density without occurrence of uneven shaving against a cleaning system or toner, the outermost surface thereof is comprised of a non-monocrystalline carbon film comprising hydrogen and having a dynamic hardness not less than 300 kgf/mm$^2$ nor more than 1300 kgf/mm$^2$ measured using a diamond stylus of a triangular pyramid having a tip of a radius not more than 0.1 $\mu$m and an edge-to-edge angle of 115°, or the outermost surface thereof is comprised of a non-monocrystalline carbon film comprising hydrogen and having a critical load at rupture of the film not less than 50 mN and not more than 700 mN measured when exerting a load on a diamond stylus having a tip of a radius not more than 15 $\mu$m while moving the stylus at an amplitude of 20 to 100 $\mu$m, an oscillation frequency of 30 Hz, and a feed rate of 2 to 20 $\mu$m/sec.

20 Claims, 3 Drawing Sheets

ELECTROPHOTOGRAPHIC PHOTOSENSITIVE MEMBER

BACKGROUND OF THE INVENTION

1. Field of the Invention

The present invention relates to an electrophotographic photosensitive member for use in the electrophotographic process, in which the outermost layer is a non-monocrystalline carbon film containing hydrogen (hereinafter referred to as "a-C:H").

2. Related Background Art

In the technology of device members used for the electrophotographic photosensitive member, there have been proposed various materials including selenium, cadmium sulfide, zinc oxide, phthalocyanine, amorphous silicon (hereinafter referred to as "a-Si"), and so on. Among others, proposed as high-performance, highly durable, and nonpolluting photosensitive members are non-monocrystalline deposited films comprising silicon atoms as a principal component, typified by a-Si, for example, amorphous deposited films such as of a-Si compensated with hydrogen and/or halogen (for example, fluorine, chlorine, etc.) or the like, some of which are put in practical use. As the forming method of such deposited films, there have been hitherto known a number of methods such as a sputtering method, a method of decomposing a source gas with heat (thermal CVD method), a method of decomposing a source gas with light (photo CVD method), a method of decomposing a source gas with plasma (plasma CVD method), and so on. Among them, the plasma CVD method is a method of decomposing a source gas by glow discharge induced by direct current, high frequency (RF, VHF), microwave, or the like and thereby forming a thin deposited film on a substrate of such a material as glass, quartz, heat-resistant synthetic resin film, stainless steel, aluminum and so on, and has been put to practical use considerably in the method of forming an a-Si deposited film for electrophotography or the like. A variety of apparatuses for practicing the method have also been proposed.

For example, Japanese Patent Application Laid-Open No. 57-115551 discloses an example of a photoconductive member in which a surface barrier layer comprised of a non-photoconductive amorphous material comprising silicon and carbon atoms as a matrix and hydrogen atoms is provided on a photoconductive layer comprised of an amorphous material comprising silicon atoms as a matrix and at least either of hydrogen atoms or halogen atoms.

Further, Japanese Patent Application Laid-Open No. 61-219961 discloses an example of an electrophotographic photosensitive member in which a surface protecting layer formed on an a-Si based photosensitive layer is comprised of a-C:H containing 10–40 atomic % of hydrogen atoms.

Japanese Patent Application Laid-Open No. 6-317920 discloses a method of producing an electrophotographic photosensitive member formed of a photoconductive layer comprised of a non-monocrystalline silicon based material comprising silicon atoms as a matrix, and an a-C:H surface protecting layer containing 8–45 atomic % of hydrogen atoms, using a high-frequency wave of the frequency not less than 20 MHz.

Further, Japanese Patent Application Laid-Open No. 60-186849 discloses a method and apparatus for forming an electrophotographic device having a top inhibiting layer formed by the microwave plasma CVD method using the microwave (for example, of the frequency 2.45 GHz) as a source gas decomposing means.

These techniques improved the electrical, optical, and photoconductive characteristics, operating circumstance characteristics, and durability and further implemented improvement in image quality.

However, the electrophotographic devices tend to increase the operation speed and lifetime further in recent years. Under such circumstances, even the electrophotographic photosensitive members, which have demonstrated sufficient performance heretofore, might suffer, for example, fusion in certain cases, depending upon the operating circumstances or the structure of the main body of electrophotographic apparatus. The "fusion" is a phenomenon in which a toner melts to adhere to a surface of the electrophotographic photosensitive member during long-term use. The adhesion, depending upon the degree thereof, will result in fusion marks in a solid white image or in a halftone image and will pose a problem in practical use. With occurrence of such fusion resulting in the fusion marks on the image, a service technician has to visit a customer to perform maintenance, which requires an extra maintenance fee. Since the maintenance was carried out after the photosensitive member was dismounted from the main body of electrophotographic apparatus, there was a risk of scratching the photosensitive member during the work to disable it.

In recent years, while development of OA devices which are harmless to the global environment is driven under leading by nations and governments, the tendency of saving of energy and resources is becoming stronger and stronger than before in the field of the electrophotographic apparatus as well. Efforts have been made from various aspects on the energy and resources saving in the electrophotographic apparatus and an example among them is an attempt of power saving of a fixing unit for fixing a toner onto paper. In the conventional apparatuses, the fixing unit is provided internally with a heater to always maintain a fixing roller at 150° C. to 200° C. and to melt the toner, thereby fixing it onto paper. Power consumption of the fixing unit can be decreased by lowering the maintained temperature of the fixing roller. In this case, in order to avoid fixing failure of a toner, the toner used is also switched to a low-melting-point toner capable of being melted to be fixed at a lower temperature. In this case, there arise no practical problems as to the image quality and the fixing property. However, when such a low-melting-point toner was used, there were some cases where the fusion stated previously became easy to occur, depending upon combination of the operating circumstances of the electrophotographic apparatus, components in the toner, the surface property of the electrophotographic photosensitive member, urging pressure of a cleaner, processing speed, and so on.

Further, since the color toner used in a full color electrophotographic apparatus was originally a low-melting-point toner, the circumstances thereof were originally such that the fusion was easy to occur.

A conceivable method of preventing this fusion is a method of polishing the surface of the electrophotographic photosensitive member to shave off the fusion source together with the film surface. However, in the case of the electrophotographic photosensitive member with high hardness of the a-Si type, the surface was not shaven into a smooth surface, but uneven shaving occurred in a stripe pattern. This uneven shaving of the stripe pattern appeared on the image and it was common practice heretofore to use the a-Si type electrophotographic photosensitive member under such conditions as not to cause shaving of surface.

Another method of preventing the fusion is a method of adding silica or the like as an abrasive to the toner itself, changing the component thereof, or increasing the quantity thereof. When the toner itself contains the abrasive, the capability of rubbing the drum surface is enhanced thereby, so that the melted toner becomes less likely to adhere to the surface. However, this can prevent the fusion on one hand, but the capability of rubbing the surface of photosensitive member is also enhanced as a side effect on the other hand. Therefore, it was difficult to strike a balance within the range in which only the fusion was improved without shaving the surface of the photosensitive member.

Further, in order to prevent the fusion, there has been employed a method of increasing the urging pressure of the cleaner and scraping off all the toner to keep the toner from adhering to the surface. However, in order to prevent polishing of the surface of photosensitive member while preventing the fusion, a delicate balance is also required. Therefore, there has been the problem that it is difficult to constantly prevent the fusion for all of electrophotographic apparatuses under mass production.

SUMMARY OF THE INVENTION

The present invention has been accomplished in order to solve the problems in the conventional technology described above and an object of the present invention is to provide an excellent electrophotographic photosensitive member that does not suffer the fusion, even under any circumstances or in any apparatus structure of the electrophotographic apparatus body, in the recent electrophotographic apparatus having the increased operation speed and extended lifetime.

Another object of the present invention is to provide an electrophotographic photosensitive member best-suited to power-saving, global environment-harmless, and less power consuming electrophotographic apparatus.

Still another object of the present invention is to provide an electrophotographic photosensitive member that can always maintain good images, without occurrence of the fusion of a toner, even in the electrophotographic apparatus using any toner including the low-melting-point toner.

Still another object of the present invention is to provide an electrophotographic photosensitive member that is also suitably applicable to the full color electrophotographic apparatus and does not pose the problems of the fusion or the like.

Still another object of the present invention is to provide an electrophotographic photosensitive member that can always maintain good images, without occurrence of the fusion of toner even in any combination of the operating circumstances, the surface property of the electrophotographic photosensitive member, the urging pressure of the cleaner, the processing speed, components contained in the toner, and so on.

A further object of the present invention is to provide an electrophotographic photosensitive member that can always maintain good images of high resolution and uniform density, without occurrence of the uneven shaving, for any cleaning system or toner.

According to an aspect of the present invention, there is provided an electrophotographic photosensitive member having an outermost surface comprised of a non-monocrystalline carbon film comprising hydrogen, the non-monocrystalline carbon film having a dynamic hardness not less than 300 kgf/mm$^2$ and not more than 1300 kgf/mm$^2$ measured using a diamond stylus of a triangular pyramid having a tip of a radius not more than 0.1 $\mu$m and an edge-to-edge angle of 115°.

According to another aspect of the present invention, there is provided an electrophotographic photosensitive member having an outermost surface comprised of a non-monocrystalline carbon film comprising hydrogen, the non-monocrystalline carbon film having a critical load at rupture of the film not less than 50 mN and not more than 700 mN measured when exerting a load on a diamond stylus having a tip of a radius not more than 15 $\mu$m while moving the stylus at an amplitude of 20–100 $\mu$m, an oscillation frequency of 30 Hz, and a feed rate of 2–20 $\mu$m/sec.

DETAILED DESCRIPTION OF THE PREFERRED EMBODIMENTS

Figure 1:
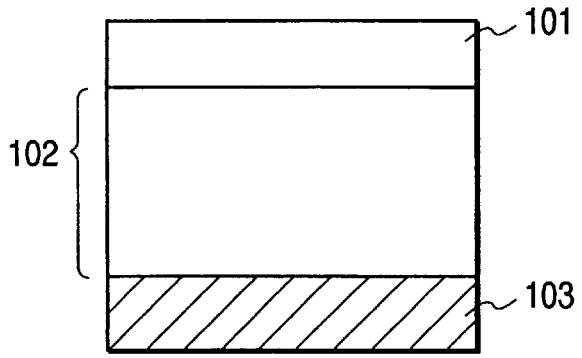
FIGS. 1, 2, 3 and 4 are schematic sectional views for explaining an example of a layer structure suitably applicable to an electrophotographic photosensitive member, respectively.

The present invention implemented the excellent electrophotographic photosensitive members without occurrence of the fusion by the above-stated structures, which were based on the following study results by the inventors.

The inventors have been studying heretofore the phenomenon of the so-called fusion in which a toner is melted to adhere to a surface of an electrophotographic photosensitive member. This fusion of a toner is the phenomenon often observed particularly in the case of the low-melting-point toner. The low-melting-point toner is often used, because fixing failure will not occur when the set temperature of the fixing unit is lowered in order to decrease power consumption from the recent requirements of energy saving.

Through the studies heretofore, the inventors have found that prevention of the fusion was achieved effectively by increasing the so-called polishing capability, e.g., increasing the urging pressure of the cleaning blade, increasing the amount of the silica component which is added as an external additive to the toner, or the like. However, this increase of the polishing capability resulted in also polishing the electrophotographic photosensitive member itself, thus causing uneven shaving in the stripe pattern, which in turn resulted in inducing the negative effect of damaging the halftone image or the solid black image and thus considerably lowering the image.

Therefore, there has been a need for developing a material having surface characteristics resistant to the fusion or for studying a material for forming the outermost surface of the electrophotographic photosensitive member capable of being smoothly shaved without occurrence of uneven shaving in the stripe pattern, even when the surface of the photosensitive member was shaven as a consequence of the increase of the blade pressure or the increase of the polishing capability by addition of the external additive to the toner. The studies heretofore found no such materials out of amorphous silicon carbide films, amorphous silicon nitride films, amorphous silicon oxide films, etc. conventionally used.

As a consequence of extensive studies, the inventors have found that the material of a-C:H has a high hardness and the material itself has lubricity, and therefore that it is relatively suitable for overcoming these problems. Then the inventors have investigated the fusion phenomenon of a toner under various circumstances and found that even when using the same a-C:H film, there are cases where the fusion occurs depending upon the fabrication conditions or where the uneven shaving of the stripe pattern occurs depending upon the pressure of the cleaning blade or the like.

As a result of further investigation of these phenomena, the inventors have found that the optimum deposited film for the objects of the present invention is obtained without occurrence of the fusion of the toner and without occurrence of the uneven shaving of a stripe pattern when the film is an a-C:H film formed under the conditions set such that the dynamic hardness of the film is not less than 300 kgf/mm$^2$ and not more than 1300 kgf /mm$^2$ when measured using a diamond stylus of a triangular pyramid having a tip of a radius not more than 0.1 $\mu$m and an edge-to-edge angle of 115°.

Further, the inventors have also found that the optimum deposited film for the objects of the present invention is obtained without occurrence of the fusion of toner and without occurrence of the uneven shaving of a stripe pattern when the film is an a-C:H film formed under the conditions set such that when exerting a load on a diamond stylus having a tip of a radius not more than 15 $\mu$m while moving the stylus at an amplitude of 20 to 100 $\mu$m, an oscillation frequency of 30 Hz, and a feed rate of 2 to 20 $\mu$m/sec, rupture of the film occurs with a critical load being within a load range of not less than 50 mN and not more than 700 mN.

The inventors have investigated the a-C:H films satisfying these specific conditions in further detail and found that in those deposited films which have a moderate hardness, the surfaces thereof are polished, though in a small amount, when used in the electrophotographic apparatus. It is postulated that this small polishing action prevents the adhesion of toner and in turn the occurrence of fusion. Further, the significant feature of a-C:H satisfying the above conditions is that the stripe shaving or uneven shaving does not occur at all in spite of such abrasion of the film described above, and that the surface is always smooth in long-term use, thus causing no image unevenness, etc. It is assumed that this is related to peculiar lubrication action achieved only under the specific conditions.

The inventors have not clearly understood so far the reason why the characteristics of electrophotographic photosensitive members are reflected well by such scratch test or dynamic hardness test under the designated specific conditions, but such scratch test or dynamic hardness test (indentation test) does not simply measure only the adhesion between the deposited film and the substrate or only the hardness of the deposited film, but measures also a friction coefficient with the deposited film, which is determined by the material of the stylus, minute chatter of the stylus, surface configuration of the deposited film, hardness of the deposited film, and so on, or also a friction coefficient with the deposited film, which is determined by the material of the stylus, elasticity of the deposited film, microscopic surface configuration of the deposited film, and so on.

Therefore, we consider that when the material and curvature of the stylus are defined and the conditions of the scratch test are defined precisely, the interaction of a contact portion with the a-C:H film and the mechanism of friction and abrasion well reflect the mechanism of friction with the cleaning blade and the toner occurring in the electrophotographic apparatus, or the interaction of the contact portion with the a-C:H film and the mechanism of friction and elasticity well reflect the mechanism of friction with the cleaning blade and the toner occurring in the electrophotographic apparatus, and that the objects of the present invention are achieved by controlling the film forming conditions so as to be within a certain range under the conditions defined above.

The electrophotographic photosensitive member having the outermost surface of the a-C:H film according to the present invention can be prepared, for example, by the ordinary plasma CVD method. In general, the plasma CVD method has great apparatus-dependence, and thus the deposition conditions to obtain the a-G:H film according to the present invention cannot be specified uniformly. In general, the characteristics of formed films vary greatly, depending upon the source gas species, carrier gas species, gas mixing method, gas introducing method, adjustment of exhausting configuration, adjustment of pressure, adjustment of power, adjustment of frequency, adjustment of power waveform, adjustment of dc bias, adjustment of substrate temperature, adjustment of film forming time, and so on. Accordingly, the control of the critical load in the scratch test under the specific conditions or the control of the indentation hardness in the dynamic hardness test under the specific conditions according to the present invention can be achieved readily even in any film forming apparatus by properly adjusting these parameters to set the conditions.

In the dynamic hardness test, where the value of dynamic hardness was not more than 300 kgf/mm$^2$, the uneven shaving of a stripe pattern sometimes occurred with progress of a durability test to sometimes pose the problem of low durability in practical use. When the dynamic hardness was not less than 1300 kgf/mm$^2$, the negative effect of uneven shaving or the like did not occur, but the fusion of toner sometimes occurred depending upon the ambient conditions. It is thus necessary that the value of dynamic hardness fall within the range of 300 kgf/mm$^2$ to 1300 kgf/mm$^2$ and more preferably within the range of 400 kgf/mm$^2$ to 1000 kgf/mm$^2$.

In the scratch test, where the load at rupture of the outermost film was not more than 50 mN, the uneven shaving of a stripe pattern sometimes occurred with progress of the durability test to sometimes pose the problem of low durability in practical use. When the load was not less than 700 mN, the negative effect of uneven shaving or the like did not occur, but the fusion of toner sometimes occurred depending upon the ambient conditions. It is thus preferable that the critical load fall within the range of 50 mN to 700 mN.

An embodiment of the present invention will be described referring to the drawings.

FIG. 1 is a schematic sectional view of an electrophotographic photosensitive member according to the present invention. In the figure, reference numeral 101 designates an outermost layer of the electrophotographic photosensitive member, and the a-C:H film according to the present invention corresponds to this part. Numeral 102 designates a photoconductive layer containing silicon atoms as a matrix and numeral 103 a substrate.

The surface layer 101 according to the present invention is comprised of a-C:H and is made typically by the plasma CVD method, using hydrocarbon as a source gas.

The content of hydrogen atoms in the a-C:H film is preferably 10% to 60%, based on H/(C+H), and more preferably 20% to 40%. If the hydrogen content is smaller than 10%, the optical bandgap will be narrower and some films may not be suitable in terms of sensitivity. When the hydrogen content is over 60%, the hardness is lowered and shaving becomes easier to occur. The preferably usable range of the optical bandgap is generally about 1.2 eV to 2.2 eV and the optical bandgap is more preferably not less than 1.6 eV in terms of the sensitivity. The index of refraction is preferably about 1.8 to 2.8. The thickness of the film is 50 Å to 10000 Å and preferably 100 Å to 2000 Å. Thicknesses below 50 Å will often pose a problem as to the mechanical strength. Thicknesses over 10000 Å will often pose a problem as to the photosensitivity. In either case, it is necessary in terms of the hardness and lubricity that the dynamic hardness in the dynamic hardness test be in the range of 300 kgf/mm$^2$ to 1300 kgf/mm$^2$ or that the critical load in the scratch test be in the range of 50 mN to 700 mN.

Examples of substances that can be used as a carbon-supplying gas are gaseous or gasifiable hydrocarbons such as $CH_4$, $C_2H_6$, $C_3H_8$, $C_4H_{10}$, or the like which are effectively used, and among them, $CH_4$ and $C_2H_6$ can be preferably used from the aspects of easiness to handle during layer formation, high carbon supply efficiency, and so on. These carbon-supplying source gases may be used as diluted with a gas such as $H_2$, He, Ar, Ne, etc. as occasion may demand.

The surface layer of a-C:H according to the present invention may contain halogen atoms as occasion demands. Examples of substances that can be used as a gas for supply of halogen atoms are interhalogen compounds such as $F_2$, BrF, ClF, $ClF_3$, $BrF_3$, $BrF_5$, $IF_3$, $IF_7$ and so on. Further examples preferably applicable are fluorine-containing gases such as $CF_4$, $CHF_3$, $C_2F_6$, $ClF_3$, $CHClF_2$, $F_2$, $C_3F_8$, $C_4F_{10}$, or the like. Preferred halogen atoms contained in the surface layer are fluorine atoms.

The substrate temperature is adjusted in the range of room temperature to 350° C., but setting of a little lower temperature is rather preferred, because too high substrate temperatures decrease the bandgap to lower transparency.

The high-frequency power is preferably set as high as possible, because decomposition of hydrocarbon proceeds well. Specifically, a preferred power is not less than 5 W/cc against the source gas of hydrocarbon. If the power is too high, abnormal discharge will occur to degrade the characteristics of the electrophotographic photosensitive member. Therefore, the power needs to be controlled to such a level that abnormal discharge in not occurred.

The pressure in the discharge space is maintained at about 0.1 Torr to 10 Torr in the case of using the ordinary RF (typically, 13.56 MHz) power, or at about 0.1 mTorr to 100 mTorr in the case of using the VHF band (typically, 50 to 450 MHz).

As the method of producing the photoconductive layer 102 in the present invention, there can preferably be used not only the method for a non-monocrystalline film comprising silicon atoms as a matrix but also the methods for any other type of photosensitive members, including the organic photosensitive member, Se photosensitive member, CdS photosensitive member, and so on. As the forming conditions for a photoconductive layer of a non-monocrystalline material comprising silicon atoms as a matrix, a glow discharge plasma by the high-frequency power of any frequency or by microwave can be suitably used, and a source gas containing silicon atoms is decomposed by this glow discharge plasma to form the layer.

In this schematic view, the photoconductive layer is shown to be composed of a single layer which is not functionally separated and which is comprised of an amorphous material containing at least silicon atoms to exhibit the photoconductive property.

Figure 2:
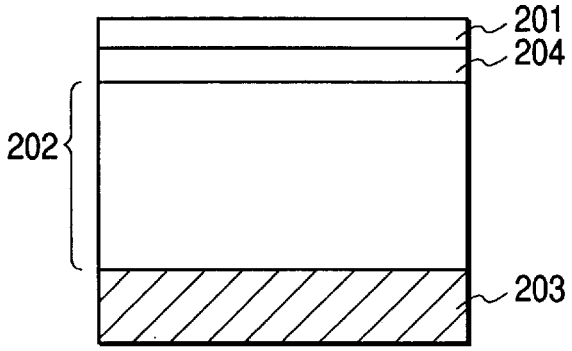

Further, as illustrated in FIG. 2, the surface layer does not always have to be composed of a single layer of the a-C:H film according to the present invention, but the surface layer may be composed by providing a first surface layer 204 of amorphous silicon carbide, amorphous silicon nitride, amorphous silicon oxide, or the like, and stacking the a-C:H film 201 according to the present invention thereon, as occasion may demand. The effect of the present invention can be achieved when the outermost layer is comprised of an a-C:H film having a dynamic hardness in the range of 300 kgf/mm$^2$ to 1300 kgf/mm$^2$, where it is further preferable that the value of the critical load in the scratch test is 50 mN to 700 mN.

Figure 3:
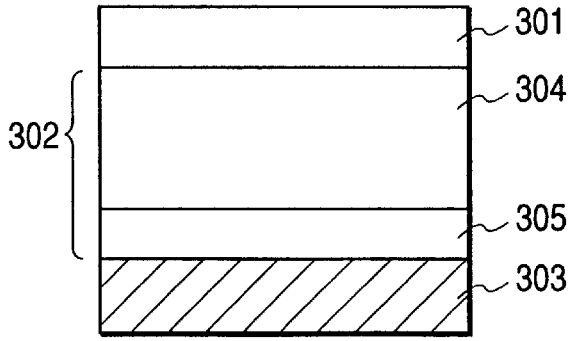

In addition, as illustrated in FIG. 3, the photoconductive layer 302 may be composed of two layers, a layer 304 with the photoconductive property comprised of an amorphous material containing at least silicon atoms and a lower inhibiting layer 305 for inhibiting injection of carriers from the substrate 303.

Figure 4:
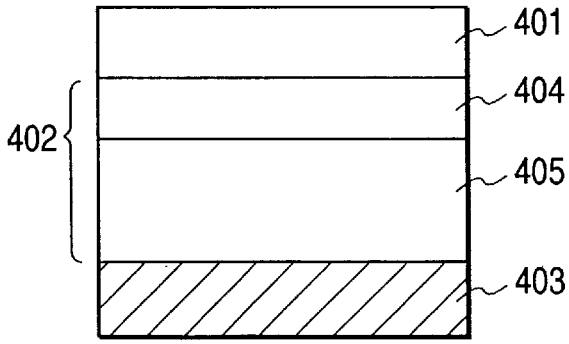

Further, as illustrated in FIG. 4, the photoconductive layer 402 may be of a functionally separated type in successively stacked structure of a charge transporting layer 405 comprised of an amorphous material containing at least silicon atoms and carbon atoms, and a charge generating layer 404 comprised of an amorphous material containing at least silicon atoms. When this electrophotographic photosensitive member is exposed to light, carriers mainly generated in the charge generating layer 404 move through the charge transporting layer 405 to reach the conductive substrate 403.

It is needless to mention that the effect of the present invention can also be achieved when the surface layer in the layer structures illustrated in FIG. 3 and FIG. 4 is of the double-layered structure as illustrated in FIG. 2.

The thickness of the photoconductive layer is suitably determined in the range of 1 $\mu$m to 50 $\mu$m, depending on the chargeability and sensitivity required by the copying machine body, but it is normally preferably not less than 10 $\mu$m in terms of the chargeability and sensitivity and not more than 50 $\mu$m in terms of industrial productivity.

Figure 5:
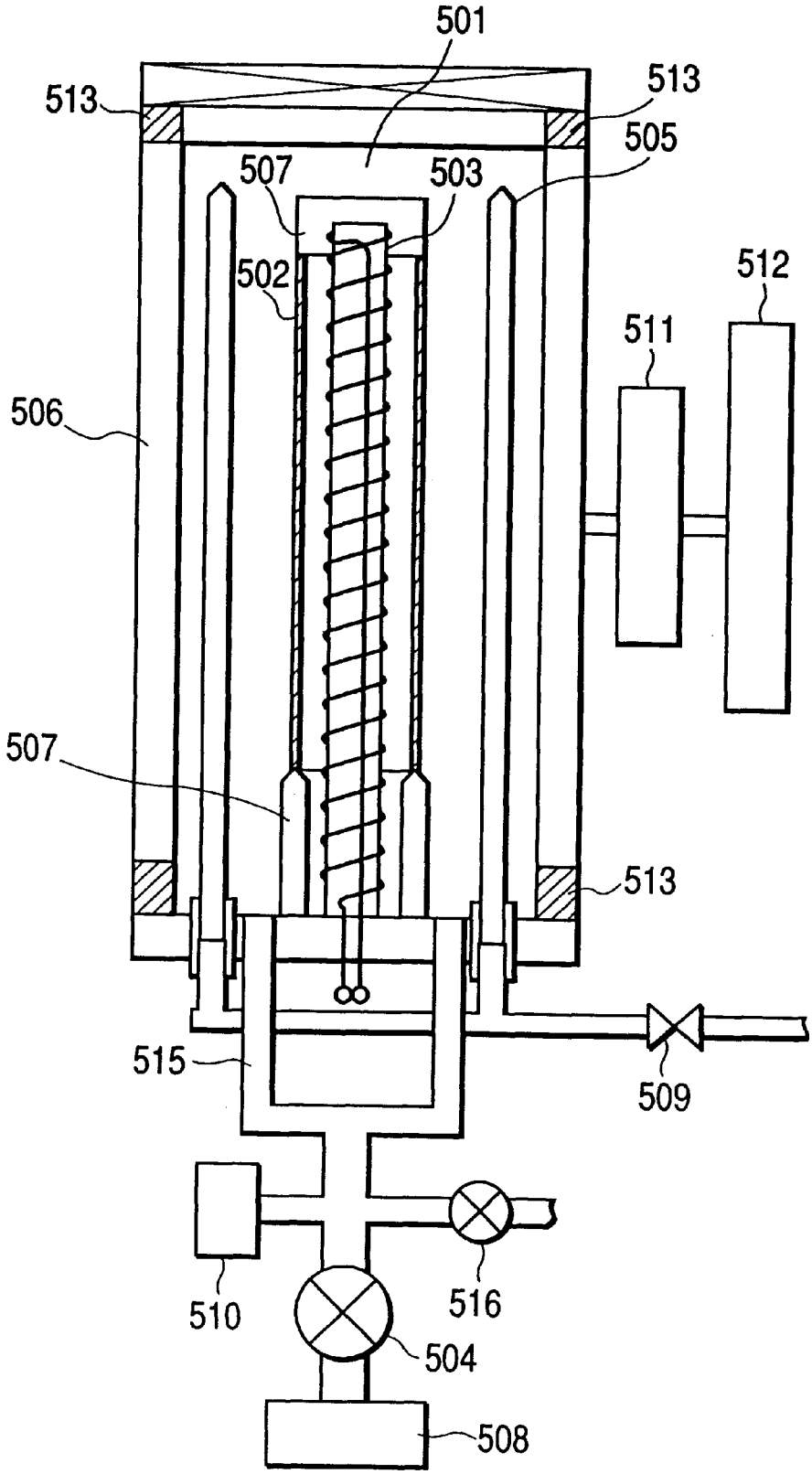
FIGS. 5 and 6 are schematic, sectional, structural diagrams for explaining an example of a deposited film forming apparatus which can be used for producing an electrophotographic photosensitive member, respectively.

FIG. 5 is a view which schematically shows an example of a deposition apparatus by the plasma CVD method using the high-frequency power source of 13.56 MHz, which is used for preparation of the electrophotographic photosensitive member according to the present invention.

This apparatus is generally composed of a deposition unit and an exhaust unit (not shown) for depressurizing the inside of a reaction vessel. In the reaction vessel 501 a cylindrical substrate 502 on which a film is to be formed is set on an electroconductive receiver 507 connected to the ground and there are a heater 503 for heating the cylindrical substrate and source gas inlet pipes 505 further provided. A cathode electrode 506 is comprised of an electroconductive material and is insulated by insulating material 513. The cathode electrode is connected through a high-frequency matching box 511 to a high-frequency power source 512 of 13.56 MHz.

Cylinders of respective component gases in a source gas supplying unit not shown are connected through a valve 509 to the gas inlet pipes 505 inside the reaction vessel 501.

Described below is an example of a method of forming an electrophotographic photosensitive member, using the apparatus of FIG. 5.

For example, the substrate 502, the surface of which was mirror-finished by a lathe, is mounted on the auxiliary base 507 so that it embraces the heater 503 for heating the substrate in the reaction vessel 501.

Then the source gas introducing valve 509 is closed and the reaction vessel 501 is once evacuated through exhaust ports 515 by the exhaust unit 508. After that, the source gas introducing valve 509 is opened to introduce an inert gas for heating, for example argon, through the gas supply pipes 505 into the reaction vessel 501, and the exhaust rate of the exhaust unit 508 and the flow rate of the heating gas are adjusted so that the pressure inside the reaction vessel 501 may become a desired pressure. Thereafter, a temperature controller not shown is actuated to heat the substrate 502 by the heater 503 for heating the substrate, whereby the temperature of the cylindrical substrate 502 is controlled to the predetermined temperature of 20° C. to 100° C. When the substrate 502 is heated to the desired temperature, the source gas introducing valve 509 is closed to stop the flow of gas into the reaction vessel 501.

Then the inflow valve 509 is opened and the main valve 504 is opened to evacuate the reaction vessel 501 and gas supply pipes 505 as also evacuating the inside of the gas supply unit. Then the inflow valve 509 is closed when reading of a vacuum gage 510 reaches $5\times10^{-6}$ Torr. Numeral 516 designates a leak valve.

For formation of a deposited film, the source gas introducing valve 509 is opened to introduce the predetermined source gas, for example a material gas such as silane gas, disilane gas, methane gas, ethane gas, or the like, optionally mixed with a doping gas such as diborane gas, phosphine gas, or the like by a mixing panel (not shown), through the source gas inlet ports 505 into the reaction vessel 501. Then a flow rate of each source gas is adjusted to a predetermined value by a mass flow controller (not shown). On that occasion, the aperture of the main valve 504 is adjusted while observing the vacuum gage 510 so that the pressure inside the reaction vessel 501 becomes the predetermined pressure not more than 1 Torr. Then the aperture of the main valve 504 is adjusted while observing the vacuum gage 510 so as to maintain the pressure of several mTorr to several Torr.

After completion of preparation for deposition according to the above procedures, the photoconductive layer is formed on the cylindrical substrate 502. After it is confirmed that the internal pressure becomes stable, the high-frequency power source 512 is set to a desired power and the high-frequency power is supplied through the matching box 511 to the cathode electrode 506 to induce a high-frequency glow discharge. At this time a matching circuit of the matching box 511 is adjusted to minimize reflected waves. The power obtained by subtracting the reflected power from the incident power of the high frequency wave is adjusted to a desired value. This discharge energy decomposes each source gas introduced into the reaction vessel 501 to form the predetermined deposited film on the cylindrical substrate 502. After the film is formed in a desired thickness, the supply of high-frequency power is stopped, the flow of each source gas into the reaction vessel 501 is also stopped, the inside of the deposition chamber is evacuated once to a high vacuum, and thereafter the formation of layer is terminated. The lower inhibiting layer and photoconductive layer are formed by repetitively carrying out the above operation.

Next, the surface layer of a-C:H according to the present invention will be formed. After the inside of the reaction vessel 501 is evacuated once to a high vacuum, a predetermined source gas, for example, a gas of hydrocarbon such as $CH_4$, $C_2H_6$, $C_3H_8$, $C_4H_{10}$, or the like, optionally mixed with a material gas such as hydrogen gas, helium gas, argon gas, or the like by a mixing panel (not shown), is introduced through the source gas inlet ports 505 into the reaction vessel 501. Then a flow rate of each source gas is adjusted to a predetermined value by a mass flow controller (not shown). On that occasion, the aperture of the main valve 504 is adjusted while observing the vacuum gage 510 so that the pressure inside the reaction vessel 501 may become the predetermined pressure not more than 1 Torr. After it is confirmed that the internal pressure becomes stable, the high-frequency power source 512 is set to a desired power and the power is supplied to the cathode electrode 506 to induce the high-frequency glow discharge. At this time the matching circuit (not shown) of the matching box 511 is adjusted so as to minimize reflected waves. The power obtained by subtracting the reflected power from the incident power of the high frequency wave is adjusted to a desired value. This discharge energy decomposes each source gas introduced into the reaction vessel 501 to form the predetermined a-C:H deposited film is formed on the photoconductive layer. After the film is formed in a desired thickness, the supply of the high-frequency power is stopped, the flow of each source into the reaction vessel 501 is also stopped, the inside of the deposition chamber is evacuated once to a high vacuum, and thereafter the formation of layer is terminated. At this time, it is necessary that the a-C:H film be formed such that the a-C:H film satisfies the conditions that the value of dynamic hardness measured using the diamond stylus of the triangular pyramid having the tip of the radius not more than 0.1 $\mu$m and the edge-to-edge angle of 115° is not less than 300 kgf/mm$^2$ and not more than 1300 kgf/mm$^2$ or such that the a-C:H film satisfies the conditions that when the load is exerted on the diamond stylus having the tip of the radius not more than 15 $\mu$m while moving the diamond stylus at the amplitude of 20 to 100 $\mu$m, the oscillation frequency of 30 Hz, and the feed rate of 2 to 20 $\mu$m/sec, the critical load at rupture of the film is not less than 50 mN and not more than 700 mN.

During the formation of film, the cylindrical substrate 502 may be rotated at a predetermined rate by a driving device (not shown).

Figure 6:
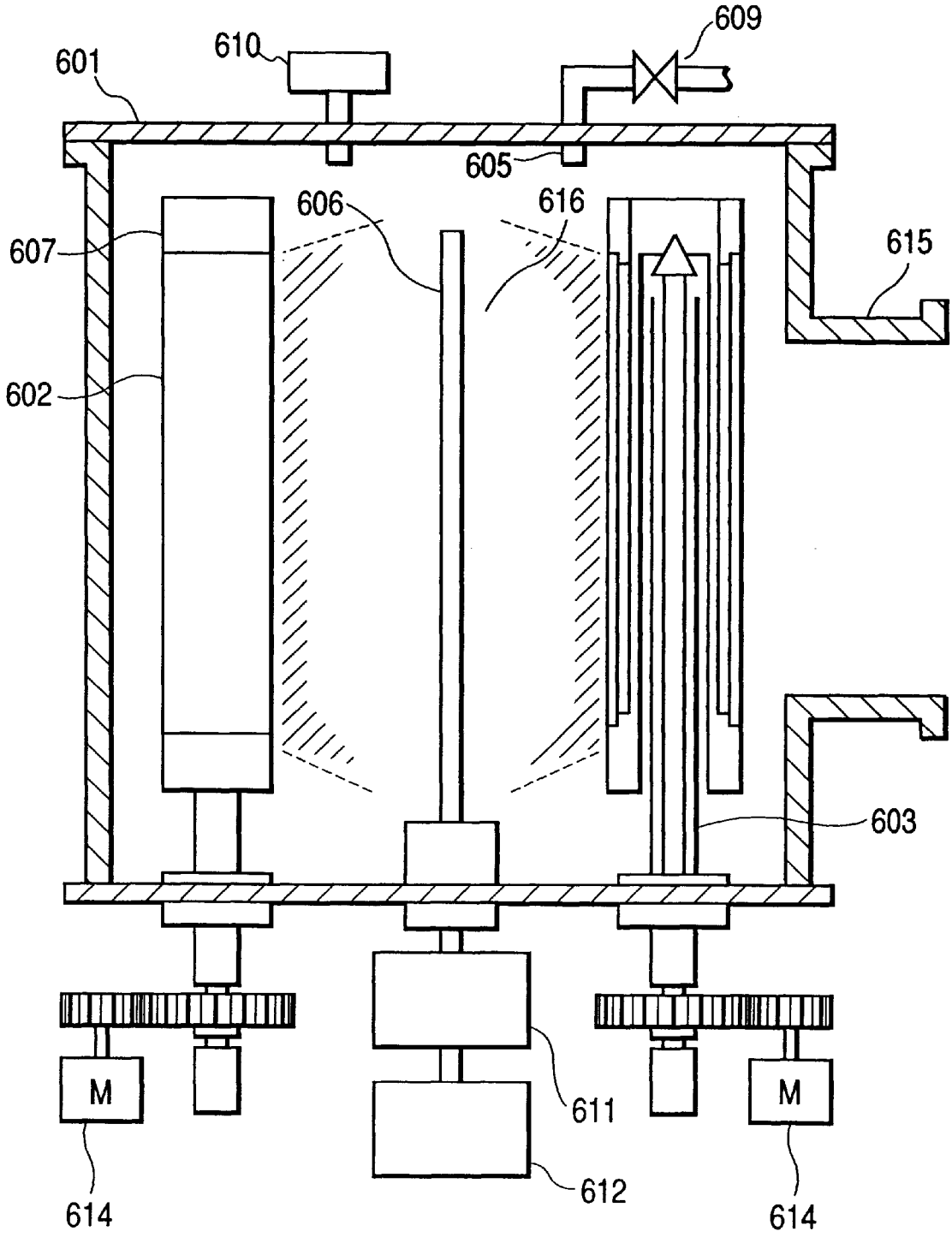

FIG. 6 is a schematic view which shows an example of an apparatus (suitable for mass production) for forming the electrophotographic photosensitive member by the plasma CVD method, which is an embodiment of the present invention different from the above-stated embodiment of FIG. 5. In the present embodiment the high-frequency power source used herein is a power source of the VHF band ranging from 50 to 450 MHz.

In FIG. 6, reference numeral 601 designates a reaction vessel which is constructed in a vacuum hermetic structure. Numeral 615 represents an exhaust pipe which is open in the reaction vessel 601 at one end and which is in communication with an exhaust unit (not shown) at the other end. Numeral 616 denotes a discharge space surrounded by cylindrical substrates 602 on which a film is to be formed. A high-frequency power source 612 is electrically connected through a high-frequency matching box 611 to a cathode electrode 606. Each cylindrical substrate 602 is set in a holder 607 and then mounted in that state on a rotational shaft 603. In the figure numeral 609 designates a source gas introducing valve and 610 a vacuum gage.

The procedures in the method of forming the electrophotographic photosensitive member using the apparatus of FIG. 6 are basically the same as those in the method using the apparatus of FIG. 5 except that the configuration of the cathode and substrates is different and the substrates are always driven by respective rotary motors 614.

EXAMPLES

Examples of the present invention will be described below, but it should be noted that the present invention is by no means intended to be limited to these examples.

Example 1

Using the plasma CVD apparatus illustrated in FIG. 5, a lower inhibiting layer and a photoconductive layer were successively stacked on cylindrical Al substrates under the conditions shown in Table 1, respectively. The procedures of film formation were carried out according to the method described above. Subsequently, surface layers of a-C:H, Sample Names 1A to 1E, were each stacked on one substrate under the conditions shown in Table 2, thereby preparing totally five electrophotographic photosensitive members. At the same time, surface layers 1A to 1E were also each deposited on 7059 glass (mfd. by Corning Glassworks) as mirror-polished and an Si-wafer, under the same fabrication conditions, thereby preparing samples for the indentation test and infrared absorption spectrum measurement.

TABLE 1

Fabrication Conditions of Electrophotographic Photosensitive Member

| | | |
|---|---|---|
| Lower inhibiting layer | $SiH_4$ | 300 sccm |
| | $H_2$ | 500 sccm |
| | NO | 8 sccm |
| | $B_2H_6$ | 2000 ppm |
| | power | 100 W |
| | internal pressure | 0.4 Torr |
| | thickness | 1 $\mu$m |
| Photoconductive layer | $SiH_4$ | 500 sccm |
| | $H_2$ | 500 sccm |
| | power | 400 W |
| | internal pressure | 0.5 Torr |
| | thickness | 20 $\mu$m |

TABLE 2

Fabrication Conditions of a-C:H Surface Layer

| Sample Name | $CH_4$ (sccm) | Power (W) | Pressure (Torr) | Substrate temperature (° C.) |
|---|---|---|---|---|
| 1A | 20 | 100 | 0.2 | 100 |
| 1B | 50 | 1000 | 0.3 | 100 |
| 1C | 250 | 600 | 0.5 | 180 |
| 1D | 300 | 1200 | 0.5 | 180 |
| 1E | 500 | 1500 | 0.4 | 150 |

Evaluation was conducted as follows for the electrophotographic photosensitive members and the surface layer samples prepared as described above.

(1) Bandgap and Index of Refraction

The bandgap and the index of refraction were obtained using an ultraviolet-near infrared spectrometer.

(2) Content of hydrogen

The content of hydrogen in the film was obtained from an infrared absorption spectrum and the thickness of film.

(3) Dynamic Hardness Test

A diamond stylus of a triangular pyramid having a tip of a radius not more than 0.1 $\mu$m and an edge-to-edge angle of 115° was placed on the surface of each surface layer sample deposited on 7059 glass, a load was exerted on the diamond stylus in the vertical direction, and the dynamic hardness DH was computed from the equation of $DH=\alpha \times p/d^2$ defining the relation between the load and the indentation depth. In this equation, $\alpha$: 37.8, p: load (gf), and d: indentation depth ($\mu$m). The indentation depth was intended to be approximately one fifth of the thickness of the outermost a-C:H film in order to prevent influence on the underlying base.

(4) Evaluation of Fusion

In a durability test using an electrophotographic apparatus (NP6060 mfd. by CANON Inc.), the urging pressure of the cleaning blade was decreased to half and the surface temperature of the drum was set to 60° C., thereby creating an environment in which the fusion was easy to occur. Each of the electrophotographic photosensitive members was mounted in the accelerated test machine thus modified and was subjected to a durability test for 100000 sheets. After the durability test, halftone images, and the surfaces of the electrophotographic photosensitive members were observed with a microscope to check presence or absence of fusion.

Criteria for evaluation of fusion were as follows.

o: very good with no fusion being observed throughout the entire surface of the photosensitive member;

Δ: no problem with slight fusion being observed but without influence on the image;

x: fusion occurred to appear on the image, which could pose a problem in practical use.

(5) Evaluation of Uneven Shaving

The thicknesses of the surface layer of the electrophotographic photosensitive members for electrophotography subjected to the durability test in (4) were measured before and after the durability test by a reflection type interferometer. The halftone images and the surfaces of the electrophotographic photosensitive members were visually observed to check presence or absence of stripe shaving and abrasion of surface layer.

Criteria for evaluation of uneven shaving were as follows.

o: very good with neither uneven shaving nor stripe shaving being observed on both the surface of photosensitive member and the image;

Δ: slight uneven shaving observed on the surface of photosensitive member but no effect on the image;

x: flaws formed to appear on the image, which could pose a problem in practical use.

(6) Chargeability

Each electrophotographic photosensitive member was mounted on an electrophotographic apparatus (NP-6060 mfd. by CANON Inc.) modified for experiments and the high voltage of +6 kV was applied to the charger in a dark state to induce corona charging. The surface potential at this time was measured by a surface electrometer to effect evaluation.

(7) Sensitivity

Each electrophotographic photosensitive member was charged to a fixed dark surface potential. Immediately after it, the electrophotographic photosensitive member was irradiated with a halogen lamp light from which light of the wavelength region of not less than 600 nm was removed by use of a filter, and the quantity of light was adjusted so that the bright surface potential (i. e., surface potential under irradiation with light) of the electrophotographic photosensitive member became a predetermined value (for example, 50 V). The quantity of light necessary at this time was computed from on voltage of the halogen lamp source. The sensitivity of each electrophotographic photosensitive member was measured to effect evaluation according to the above procedures.

(8) Residual Potential

Each electrophotographic photosensitive member was charged to a fixed dark surface potential. Immediately after it, the photosensitive member was irradiated with a relatively strong light of a fixed light quantity (for example, 2 lux.sec). A xenon lamp was used as a light source, and the light of the lamp from which light of the wavelength region of not less than 600 nm was removed by use of a filter was used. The bright surface potential of each electrophotographic photosensitive member at this time was measured by a surface electrometer and the residual potential thereof was evaluated.

Criteria for each evaluation of chargeability, sensitivity, and residual potential were as follows.

o: good

Δ: practically acceptable level x: possibly posing a problem in practical use.

Comparative Example 1

Using the plasma CVD apparatus illustrated in FIG. 5, a lower inhibiting layer and a photoconductive layer were successively stacked on Al substrate under the conditions shown in Table 1, respectively. The procedures of film formation were according to the method described above. Subsequently, surface layers of a-C:H, Sample Names 1F to 1H, were each stacked on one substrate under the conditions shown in Table 3, thereby preparing totally three electrophotographic photosensitive members. At the same time, surface layers 1F to 1H were also each deposited on 7059 glass (mfd. by Corning Glassworks) as mirror-polished and an Si-wafer, thereby preparing samples for the indentation test and infrared absorption spectrum measurement.

TABLE 3

Fabrication Conditions of a-C:H Surface Layer

| Sample Name | $C_4H_6$ (sccm) | Power (W) | Pressure (Torr) | Substrate temperature (° C.) |
|---|---|---|---|---|
| 1F | 500 | 500 | 0.65 | 100 |
| 1G | 1000 | 200 | 0.4 | room temperature |
| 1H | 10 | 1000 | 0.2 | 250 |

The electrophotographic photosensitive members and the surface layer samples fabricated in this way were evaluated in the same manner as in Example 1.

The results of Example 1 and Comparative Example 1 are shown together in Table 4. In the range of indentation hardness from 300 kgf/mm$^2$ to 1300 kgf/mm$^2$ under the exactly defined conditions of the indentation test, neither fusion nor uneven shaving was observed, thus obtaining the very good results. All the photosensitive members demonstrated good electrical characteristics necessary for electrophotography and it was verified that there occurred no trouble with the a-C:H film of the present invention provided in the surface. Particularly, in the range of indentation hardness from 400 kgf/mm$^2$ to 1000 kgf/mm$^2$, the chargeability was excellent.

TABLE 4

| | | Band-gap (eV) | Refractive Index | $H_2$ content in film (%) | Indentation hardness (kgf/mm$^2$) | Fusion | Uneven shaving | Charge-ability | Sensi-tivity | Residual potential |
|---|---|---|---|---|---|---|---|---|---|---|
| Ex. 1 | 1A | 2.0 | 1.8 | 55 | 323 | ○ | Δ | ○ | Δ | Δ |
| | 1B | 1.6 | 2.1 | 30 | 1250 | ○ | ○ | Δ | Δ | Δ |
| | 1C | 1.4 | 1.9 | 40 | 416 | ○ | ○ | ○ | Δ | Δ |
| | 1D | 1.3 | 1.9 | 44 | 559 | ○ | ○ | ○ | Δ | Δ |
| | 1E | 1.5 | 2.1 | 34 | 1000 | ○ | ○ | ○ | Δ | Δ |
| Comp. | 1F | 1.4 | 1.7 | 48 | 235 | Δ | X | Δ | Δ | Δ |
| Ex. 1 | 1G | 2.2 | 1.7 | 62 | 98 | Δ | X | Δ | Δ | Δ |
| | 1H | 1.2 | 2.3 | 7 | 1380 | X | ○ | Δ | Δ | Δ |

Example 2

Using the plasma CVD apparatus illustrated in FIG. 6, a charge transporting layer and a charge generating layer were successively stacked on Al substrate under the conditions shown in Table 5, respectively. The procedures of film formation were according to the method described above. Subsequently, surface layers of a-C:H, 2A to 2E, were each stacked on one substrate under the conditions shown in Table 6, thereby preparing totally five electrophotographic photosensitive members. At the same time, surface layers 2A to 2E were also each deposited on 7059 glass (mfd. by Corning Glassworks) as mirror-polished and an Si-wafer, thereby preparing samples for the indentation test and infrared absorption spectrum measurement.

The electrophotographic photosensitive members and the surface layer samples fabricated in this way were evaluated in the same manner as in Example 1.

TABLE 5

Fabrication Conditions of Electrophotographic Photosensitive Member

| | | |
|---|---|---|
| Charge transport layer | $SiH_4$ | 500 sccm |
| | $CH_4$ | 150 sccm |
| | $H_2$ | 300 sccm |
| | $B_2H_6$ | 85 ppm |
| | power | 500 W |
| | internal pressure | 50 mTorr |
| | thickness | 20 μm |
| Charge generating layer | $SiH_4$ | 350 sccm |
| | $H_2$ | 600 sccm |
| | power | 500 W |
| | internal pressure | 50 mTorr |
| | thickness | 2 μm |

TABLE 6

Fabrication Conditions of a-C:H Surface Layer

| Sample Name | $CH_4$ (sccm) | Dilution gas (sccm) | Power (W) | Pressure (mTorr) | Substrate temperature (° C.) |
|---|---|---|---|---|---|
| 2A | 20 | $H_2$: 500 | 500 | 30 | 80 |
| 2B | 30 | He: 800 | 1200 | 30 | 150 |
| 2C | 150 | Ar: 400 | 1000 | 50 | 200 |
| 2D | 50 | He: 500 | 600 | 30 | 80 |
| 2E | 500 | $H_2$: 500 | 600 | 40 | 100 |

Comparative Example 2

Using the plasma CVD apparatus illustrated in FIG. 6, a charge transporting layer and a charge generating layer were successively stacked on Al substrates under the conditions shown in Table 5, respectively. The procedures of film formation were according to the method described above. Subsequently, surface layers of a-C:H, 2F to 2H, were each stacked on one substrate under the conditions shown in Table 7, thereby preparing totally three electrophotographic photosensitive members. At the same time, surface layers 2F to 2H were also each deposited on 7059 glass (mfd. by Corning Glassworks) as mirror-polished and an Si-wafer, thereby preparing samples for the indentation test and infrared absorption spectrum measurement.

The electrophotographic photosensitive members and the surface layer samples fabricated in this way were evaluated in the same manner as in Example 1.

TABLE 7

Fabrication Conditions of a-C:H Surface layer

| Sample Name | $C_2H_2$ (sccm) | Dilution gas (sccm) | Power (W) | Pressure (mTorr) | Substrate temperature (° C.) |
|---|---|---|---|---|---|
| 2F | 400 | $H_2$: 300 | 500 | 50 | 150 |
| 2G | 1000 | He: 500 | 250 | 40 | 100 |
| 2H | 10 | Ar: 300 | 1000 | 30 | 50 |

The results of Example 2 and Comparative Example 2 are shown together in Table 8. It was verified that the effect of the present invention was also achieved without any problem where the layer structure of the photosensitive layer was of the functionally separated type of the charge transporting layer and the charge generating layer. It was also verified that the effect of the present invention was not negatively affected by use of $H_2$, He, Ar, etc. as a dilution gas on the occasion of film formation of the a-C:H film of the present invention.

TABLE 9-continued

Fabrication Conditions of Electrophotographic Photosensitive Member

| | | |
|---|---|---|
| | NO | 5 sccm |
| | $B_2H_6$ | 1500 ppm |
| | power | 200 W |
| | internal pressure | 0.5 Torr |
| | thickness | 1 μm |
| Photoconductive layer | $SiH_4$ | 200 sccm |
| | $H_2$ | 600 sccm |
| | power | 600 W |
| | internal pressure | 0.5 Torr |
| | thickness | 20 μm |
| First surface layer | $SiH_4$ | 50 sccm |
| | $CH_4$ | 500 sccm |
| | power | 300 W |
| | internal pressure | 0.5 Torr |
| | thickness | 0.5 μm |
| Second surface layer | $CH_4$ | 200 sccm |
| | $CF_4$ | 200 sccm |
| | power | 1800 W |
| | internal pressure | 0.5 Torr |
| | thickness | 0.1 μm |

The hardness of the sample for the dynamic hardness test produced in this way was 430 kgf/mm$^2$. Further, the electrophotographic photosensitive member was mounted on the same copying machine as in Example 1 and was subjected to the durability test of 100000 sheets. Neither fusion nor stripe shaving occurred and very good images were obtained stably over the long term.

TABLE 8

| | | Band-gap (eV) | Refractive Index | $H_2$ content in film (%) | Indentation hardness (kgf/mm$^2$) | Fusion | Uneven shaving | Charge-ability | Sensi-tivity | Residual potential |
|---|---|---|---|---|---|---|---|---|---|---|
| Ex. 2 | 2A | 1.4 | 1.9 | 43 | 538 | ○ | ○ | ○ | Δ | Δ |
| | 2B | 1.6 | 2.2 | 22 | 1210 | ○ | ○ | Δ | Δ | Δ |
| | 2C | 1.5 | 1.9 | 30 | 990 | ○ | ○ | ○ | Δ | Δ |
| | 2D | 1.7 | 1.8 | 48 | 450 | ○ | ○ | ○ | Δ | Δ |
| | 2E | 1.9 | 1.8 | 51 | 320 | ○ | Δ | ○ | Δ | Δ |
| Comp. | 2F | 1.9 | 1.7 | 58 | 246 | Δ | X | Δ | Δ | Δ |
| Ex. 2 | 2G | 2.2 | 1.7 | 62 | 130 | Δ | X | Δ | Δ | Δ |
| | 2H | 1.2 | 2.3 | 9 | 1400 | X | ○ | Δ | Δ | Δ |

Example 3

Using the plasma CVD apparatus illustrated in FIG. 5, the electrophotographic photosensitive member of the present invention was produced on the Al substrate under the conditions shown in Table 9. The procedures of film formation were according to the method described previously. In the present example, the outermost surface layer contained fluorine from $CF_4$ gas. At the same time, a second surface layer was also deposited on 7059 glass (mfd. by Corning Glassworks) mirror-polished, under the same fabrication conditions, thereby producing a sample for the dynamic hardness test.

TABLE 9

Fabrication Conditions of Electrophotographic Photosensitive Member

| | | |
|---|---|---|
| Lower inhibiting layer | $SiH_4$ | 200 sccm |
| | $H_2$ | 600 sccm |

Example 4

Using the plasma CVD apparatus illustrated in FIG. 5, a lower inhibiting layer and a photoconductive layer were successively stacked on cylindrical Al substrates under the conditions shown in Table 10, respectively. The procedures of film formation were according to the method described above. Subsequently, surface layers of a-C:H, Sample Names 4A to 4E, were stacked on one substrate under the conditions shown in Table 11, thereby preparing totally five electrophotographic photosensitive members. At the same time, surface layers 4A to 4E were also each deposited on 7059 glass (mfd. by Corning Glassworks) as mirror-polished and an Si-wafer, under the same fabrication conditions, thereby preparing samples for the scratch test and infrared absorption spectrum measurement.

TABLE 10

| Fabrication Conditions of Electrophotographic Photosensitive Member | | |
|---|---|---|
| Lower inhibiting layer | $SiH_4$ | 100 sccm |
| | $H_2$ | 600 sccm |
| | NO | 5 sccm |
| | $B_2H_6$ | 1500 ppm |
| | power | 200 W |
| | internal pressure | 0.5 Torr |
| | thickness | 1 μm |
| Photoconductive layer | $SiH_4$ | 300 sccm |
| | $H_2$ | 600 sccm |
| | power | 600 W |
| | internal pressure | 0.5 Torr |
| | thickness | 20 μm |

TABLE 11

| Fabrication Conditions of a-C:H Surface Layer | | | | |
|---|---|---|---|---|
| Sample Name | $CH_4$ (sccm) | Power (W) | Pressure (Torr) | Substrate temperature (° C.) |
| 4A | 40 | 100 | 0.3 | 100 |
| 4B | 40 | 800 | 0.3 | 150 |
| 4C | 300 | 700 | 0.4 | 180 |
| 4D | 300 | 1000 | 0.4 | 50 |
| 4E | 600 | 1500 | 0.5 | 200 |

The electrophotographic photosensitive members and the surface layer samples produced in this way were evaluated and the scratch test thereof was carried out as follows.

(9) Scratch Test

A diamond stylus having a tip of a radius of 5 μm was placed on the surface of each surface layer sample deposited on 7059 glass, a load was exerted on the stylus while moving it at an amplitude of 50 μm, an oscillation frequency of 30 Hz, and a feed rate of 10 μm/sec, and observation was conducted to check rupture of the film surface accompanied with occurrence of a scratch noise. The critical load was measured when the film first underwent rupture.

Comparative Example 3

Using the plasma CVD apparatus illustrated in FIG. 5, a lower inhibiting layer and a photoconductive layer were successively stacked on Al substrates under the conditions shown in Table 1, respectively. The procedures of film formation were according to the method described above. Subsequently, surface layers of a-C:H, Sample Names 4F to 4H, were each stacked on one substrate under the conditions shown in Table 12, thereby preparing totally three electrophotographic photosensitive members. At the same time, surface layers 4F to 4H were also each deposited on 7059 glass (mfd. by Corning Glassworks) as mirror-polished and an Si-wafer, thereby preparing samples for the scratch test and infrared absorption spectrum measurement.

TABLE 12

| Sample Name | $C_4H_6$ (sccm) | Power (W) | Pressure (Torr) | Substrate temperature (° C.) |
|---|---|---|---|---|
| 4F | 400 | 400 | 0.6 | 100 |
| 4G | 500 | 100 | 0.4 | room temperature |
| 4H | 5 | 1000 | 0.3 | 180 |

The electrophotographic photosensitive members and the surface layer samples produced in this way were evaluated in the same manner as in Example 4.

The results of Example 4 and Comparative Example 3 are shown together in Table 13. In the range of the critical load from 50 mN to 700 mN under the exactly defined conditions of the scratch test, neither fusion nor uneven shaving occurred and the very good results were obtained. All the photosensitive members demonstrated good electrical characteristics for electrophotography and it was verified that no trouble took place with the a-C:H film of the present invention provided in the surface.

TABLE 13

| | | Band-gap (eV) | Refractive Index | $H_2$ content in film (%) | Critical load (mN) | Fusion | Uneven shaving | Charge-ability | Sensi-tivity | Residual potential |
|---|---|---|---|---|---|---|---|---|---|---|
| Ex. 4 | 4A | 1.3 | 2.1 | 37 | 60 | ○ | Δ | ○ | Δ | Δ |
| | 4B | 1.5 | 2.0 | 30 | 660 | ○ | ○ | Δ | Δ | Δ |
| | 4C | 1.4 | 2.0 | 40 | 160 | ○ | ○ | ○ | Δ | Δ |
| | 4D | 2.0 | 1.9 | 55 | 300 | ○ | ○ | ○ | Δ | Δ |
| | 4E | 1.2 | 2.1 | 34 | 410 | ○ | ○ | ○ | Δ | Δ |
| Comp. | 4F | 2.0 | 1.8 | 61 | 29 | Δ | X | Δ | Δ | Δ |
| Ex. 3 | 4G | 2.1 | 1.7 | 64 | 10 | Δ | X | Δ | Δ | Δ |
| | 4H | 1.1 | 2.3 | 8 | 710 | X | ○ | Δ | Δ | Δ |

Example 5

Using the plasma CVD apparatus illustrated in FIG. 6, a charge transporting layer and a charge generating layer were successively stacked on Al substrates under the conditions shown in Table 14, respectively. The procedures of film formation were according to the method described above. Subsequently, surface layers of a-C:H, Sample Names 5A to 5E, were each stacked on one substrate under the conditions shown in Table 15, thereby preparing totally five electrophotographic photosensitive members. At the same time, surface layers 5A to 5E were also each deposited on 7059 glass (mfd. by Corning Glassworks) as mirror-polished and an Si-wafer, thereby preparing samples for the scratch test and infrared absorption spectrum measurement.

The electrophotographic photosensitive members and the surface layer samples fabricated in this way were evaluated in the same manner as in Example 1.

TABLE 14

| Fabrication Conditions of Electrophotographic Photosensitive Member | | |
|---|---|---|
| Charge transport layer | $SiH_4$ | 100 sccm |
| | $CH_4$ | 50 sccm |
| | $H_2$ | 500 sccm |
| | $B_2H_6$ | 50 ppm |
| | power | 300 W |
| | internal pressure | 60 mTorr |
| | thickness | 20 μm |
| Charge generating layer | $SiH_4$ | 400 sccm |
| | $H_2$ | 800 sccm |
| | power | 500 W |
| | internal pressure | 50 mTorr |
| | thickness | 5 μm |

TABLE 15

Fabrication Conditions of a-C:H Surface Layer

| Sample Name | $CH_4$ (sccm) | Dilution gas (sccm) | Power (W) | Pressure (mTorr) | Substrate temperature (° C.) |
|---|---|---|---|---|---|
| 5A | 30 | $H_2$: 500 | 500 | 20 | 200 |
| 5B | 30 | He: 800 | 1500 | 20 | 50 |
| 5C | 100 | Ar: 300 | 1000 | 30 | 80 |
| 5D | 100 | He: 300 | 600 | 30 | 80 |
| 5E | 500 | $H_2$: 500 | 500 | 40 | 80 |

The results of Example 5 and Comparative Example 4 are shown together in Table 17. It was verified that the effect of the present invention was also achieved without any problem where the layer structure of the photosensitive layer was of the functionally separated type of the charge transporting layer and the charge generating layer. It was also verified that the effect of the present invention was not negatively affected by use of $H_2$, He, Ar, etc. as a dilution gas on the occasion of film formation of the a-C:H film of the present invention.

TABLE 16

Fabrication Conditions of a-C:H Surface Layer

| Sample Name | $C_2H_2$ (sccm) | Dilution gas (sccm) | Power (W) | Pressure (mTorr) | Substrate temperature (° C.) |
|---|---|---|---|---|---|
| 5F | 500 | $H_2$: 200 | 300 | 50 | 200 |
| 5G | 1000 | He: 800 | 200 | 40 | 50 |
| 5H | 10 | Ar: 200 | 1000 | 20 | 100 |

TABLE 17

| | | Band-gap (eV) | Refractive Index | $H_2$ content in film (%) | Critical load (mN) | Fusion | Uneven shaving | Charge-ability | Sensi-tivity | Residual potential |
|---|---|---|---|---|---|---|---|---|---|---|
| Ex. 5 | 5A | 1.2 | 2.2 | 20 | 300 | ○ | ○ | ○ | Δ | Δ |
| | 5B | 1.5 | 2.5 | 33 | 640 | ○ | ○ | Δ | Δ | Δ |
| | 5C | 1.4 | 2.1 | 30 | 440 | ○ | ○ | ○ | Δ | Δ |
| | 5D | 2.0 | 2.0 | 46 | 225 | ○ | ○ | ○ | Δ | Δ |
| | 5E | 1.9 | 1.9 | 50 | 50 | ○ | Δ | ○ | Δ | Δ |
| Comp. | 5F | 1.9 | 1.7 | 50 | 40 | Δ | X | Δ | Δ | Δ |
| Ex. 4 | 5G | 2.3 | 1.8 | 55 | 15 | Δ | X | Δ | Δ | Δ |
| | 5H | 1.0 | 2.4 | 9 | 715 | X | ○ | Δ | Δ | Δ |

Comparative Example 4

Using the plasma CVD apparatus illustrated in FIG. 6, a charge transporting layer and a charge generating layer were successively stacked on Al substrates under the conditions shown in Table 14. The procedures of film formation were according to the method described above. Subsequently, surface layers of a-C:H, Sample Names 5F to 5H, were each stacked on one substrate under the conditions shown in Table 16, thereby preparing totally three electrophotographic photosensitive members. At the same time, surface layers 5F to 5H were also each deposited on 7059 glass (mfd. by Corning Glassworks) as mirror-polished and an Si-wafer, thereby preparing samples for the scratch test and infrared absorption spectrum measurement.

The electrophotographic photosensitive members and the surface layer samples fabricated in this way were evaluated in the same manner as in Example 1.

Example 6

Using the plasma CVD apparatus illustrated in FIG. 5, the electrophotographic photosensitive member of the present invention was produced on an Al substrate under the conditions shown in Table 18. The procedures of film formation were according to the method described previously. In the present example, the outermost surface layer contained fluorine from $CF_4$ gas. At the same time, a second surface layer was also deposited on 7059 glass (mfd. by Corning Glassworks) mirror-polished, under the same fabrication conditions, thereby producing a sample for the scratch test.

TABLE 18

| Fabrication Conditions of Electrophotographic Photosensitive Member | | |
|---|---|---|
| Lower inhibiting layer | $SiH_4$ | 200 sccm |
| | $H_2$ | 600 sccm |
| | NO | 5 sccm |
| | $B_2H_6$ | 1500 ppm |
| | power | 200 W |

TABLE 18-continued

| Fabrication Conditions of Electrophotographic Photosensitive Member | | |
|---|---|---|
| | internal pressure | 0.5 Torr |
| | thickness | 1 μm |
| Photoconductive layer | $SiH_4$ | 200 sccm |
| | $H_2$ | 600 sccm |
| | power | 600 W |
| | internal pressure | 0.5 Torr |
| | thickness | 20 μm |
| First surface layer | $SiH_4$ | 100 sccm |
| | $CH_4$ | 500 sccm |
| | power | 200 W |
| | internal pressure | 0.5 Torr |
| | thickness | 0.5 μm |
| Second surface layer | $CH_4$ | 250 sccm |
| | $CF_4$ | 250 sccm |
| | power | 2000 W |
| | internal pressure | 0.5 Torr |
| | thickness | 0.1 μm |

The critical load of the sample for the scratch test produced in this way was 100 mN. Further, the electrophotographic photosensitive member was mounted on the same copying machine as in Example 4 and was subjected to the durability test of 100000 sheets. Neither fusion nor stripe shaving occurred and very good images were obtained stably over the long term.

According to the present invention, by forming the outermost surface of an electrophotographic photosensitive member of a non-monocrystalline carbon film comprising hydrogen wherein the dynamic hardness thereof measured using a diamond stylus of a triangular pyramid having a tip of a radius not more than 0.1 μm and an edge-to-edge angle of 115° is not less than 300 kgf/mm$^2$ and not more than 1300 kgf/mm$^2$, it is possible to implement an electrophotographic photosensitive member that does not suffer the fusion of toner or the uneven shaving under any conditions of circumstances, electrophotographic apparatus, the type of toner including the low-melting-point toner, the surface property of electrophotographic photosensitive member, the urging pressure of the cleaner, the process speed, components of toner, and so on and that can always maintain excellent images of high resolution and even density.

In addition, according to the present invention, by forming the outermost surface of an electrophotographic photosensitive member of a non-monocrystalline carbon film comprising hydrogen wherein on the occasion of application of a load on a diamond stylus having a tip of a radius not more than 15 μm while moving the stylus at an amplitude of 20 to 100 μm, an oscillation frequency of 30 Hz, and a feed rate of 2 to 20 μm/sec, the critical load at rupture of the deposited film is not less than 50 mN and not more than 700 mN, it is possible to implement an electrophotographic photosensitive member that does not suffer the fusion of toner or the uneven shaving under any conditions of circumstances, electrophotographic apparatus, the type of toner including the low-melting-point toner, the surface property of electrophotographic photosensitive member, the urging pressure of the cleaner, the process speed, components of toner, and so on and that can always maintain excellent images of high resolution and even density.

As detailed above, the present invention can provide electrophotographic photosensitive members having superior characteristics to the conventional members.

What is claimed is:

1. An electrophotographic photosensitive member having an outermost surface comprised of a non-monocrystalline carbon film comprising hydrogen, the non-monocrystalline carbon film having a dynamic hardness not less than 300 kgf/mm$^2$ and not more than 1300 kgf/mm$^2$ measured using a diamond stylus of a triangular pyramid having a tip of a radius not more than 0.1 μm and an edge-to-edge angle of 115°.

2. The electrophotographic photosensitive member according to claim 1, wherein the hydrogen content of the non-monocrystalline carbon film is 10 to 60%.

3. The electrophotographic photosensitive member according to claim 1, wherein the optical bandgap of the non-monocrystalline carbon film is 1.2 to 2.2 eV.

4. The electrophotographic photosensitive member according to claim 1, wherein the refractive Index of the non-monocrystalline carbon film is 1.8 to 2.8.

5. The electrophotographic photosensitive member according to claim 1, wherein the thickness of the non-monocrystalline carbon film is 50 to 10000 Å.

6. The electrophotographic photosensitive member according to claim 1, wherein the thickness of the non-monocrystalline carbon film is 100 to 2000 Å.

7. The electrophotographic photosensitive member according to claim 1, comprising a photosensitive layer comprised of a non-monocrystalline material comprising silicon as a matrix.

8. The electrophotographic photosensitive member according to claim 1, comprising a lower inhibiting layer, a photosensitive layer, and an upper inhibiting layer.

9. The electrophotographic photosensitive member according to claim 1, comprising a charge transporting layer, a charge generating layer, and a surface protecting layer.

10. The electrophotographic photosensitive member according to claim 1, wherein the dynamic hardness of the non-monocrystalline carbon film is not less than 400 kgf/mm$^2$ and not more than 1000 kgf/mm$^2$.

11. An electrophotographic photosensitive member having an outermost surface comprised of a non-monocrystalline carbon film comprising hydrogen, the non-monocrystalline carbon film having a critical load at rupture of the film not less than 50 mN and not more than 700 mN measured when exerting a load on a diamond stylus having a tip of a radius not more than 15 μm while moving the stylus at an amplitude of 20–100 μm, an oscillation frequency of 30 Hz, and a feed rate of 2 to 20 μm/sec.

12. The electrophotographic photosensitive member according to claim 11, wherein the critical load at rupture of the non-monocrystalline carbon film is not less than 100 mN and not more than 500 mN.

13. The electrophotographic photosensitive member according to claim 11, wherein the hydrogen content of the non-monocrystalline carbon film is 10 to 60%.

14. The electrophotographic photosensitive member according to claim 11, wherein the optical bandgap of the non-monocrystalline carbon film Is 1.2 to 2.2 eV.

15. The electrophotographic photosensitive member according to claim 11, wherein the refractive index of the non-monocrystalline carbon film is 1.8 to 2.8.

16. The electrophotographic photosensitive member according to claim 11, wherein the thickness of the non-monocrystalline carbon film is not less than 50 Å and not more than 10000 Å.

17. The electrophotographic photosensitive member according to claim 11, wherein the thickness of the non-monocrystalline carbon film is not less than 100 Å and not more than 2000 Å.

18. The electrophotographic photosensitive member according to claim 11, comprising a photosensitive layer comprised of a non-monocrystalline material comprising silicon as a matrix.

19. The electrophotographic photosensitive member according to claim 11, comprising a lower inhibiting layer, a photosensitive layer, and an upper inhibiting layer.

20. The electrophotographic photosensitive member according to claim 11, comprising a charge transporting layer, a charge generating layer, and a surface protecting layer.

* * * * *

UNITED STATES PATENT AND TRADEMARK OFFICE

CERTIFICATE OF CORRECTION

PATENT NO. : 6,001,521 
DATED : December 14, 1999
INVENTOR(S) : Junichiro Hashizume et al.

It is certified that error appears in the above-identified patent and that said Letters Patent is hereby corrected as shown below:

Title page,
Item [57], ABSTRACT,
Line 3, "fusion of toner," should read -- toner fusion, --;
Line 8, "toner, the outermost surface thereof" should read -- toner. The outermost surface of the electrophotographic photosensitive member of the present invention --;
Line 11, "kgf /mm$^2$" should read -- kgf /mm$^2$, --;
Line 17, "mN" should read -- mN, --.

Column 1,
Line 21, "compensated" should read -- deposited --;
Line 23, "in" should read -- to --;
Line 35, "on, and" should read -- on. The plasma CVD method --.

Column 2,
Line 5, "the electrophotographic devices tend to" should be deleted;
Line 6, "increase" should be deleted; and "further" should read -- of electrophotographic devices has increased --;
Line 10, "body of" should read -- body of a given --
Line 11, "The "fusion"" should read -- "Fusion" --;
Line 12, "to" should be deleted and "adhere" should read -- thereby adhering --;
Line 16, "With occurrence of" should be deleted;
Line 17, "such fusion resulting in the" should read -- When fusion occurs with resulting --;
Lines 20, 21 and 22, "was" should read -- is --;
Line 23, "member during the work to disable it." should read -- member. --,
Line 24, "while" should read -- while the --;
Line 25, "is driven under" should read -- has been driven --;
Line 26, "leading" should be deleted; and "of saving" should read -- to save --;
Line 27, "of" should be deleted; and "is becoming stronger and stronger" should read -- has become stronger --;
Line 28, "the" should be deleted; and "apparatus" should read -- apparatuses. --;
Line 29, "as well." should be deleted, "from" should read -- in --; and "on the" should read -- regarding --;
Line 30, "in the" should read -- with respect to --;
Line 31, "apparatus" should read -- apparatuses, --; and "of" should read-- to save power in --;
Line 32, "power saving of" should be deleted;

UNITED STATES PATENT AND TRADEMARK OFFICE

CERTIFICATE OF CORRECTION

PATENT NO. : 6,001,521
DATED : December 14, 1999
INVENTOR(S) : Junichiro Hashizume et al.

It is certified that error appears in the above-identified patent and that said Letters Patent is hereby corrected as shown below:

Column 2 (con't),
Line 34, "always" should read -- constantly --;
Line 41, "there arise no practical problems" should read -- no practical problems arise --;
Line 42, "the" (both occurrence) should be deleted;
Line 43, "was" should read -- is --; and "there were some" should be deleted;
Line 44, should read -- the fusion previously described occurs more easily in some cases, --;
Line 45, "occur, depending upon combination of the" should read -- depending upon the combination of --;
Line 52, should read -- toner, fusion was much more likely to occur. --;
Line 53 should be deleted;
Lines 60 and 61, "stripe" should read -- striped --;
Line 62, "image" should read -- image, --;
Line 64, "of" should read -- of the --.

Column 3,
Line 4, "However," should read -- However, while --;
Line 5, "but" should be deleted;
Line 14, "surface of" should read -- surface of the --;
Line 17, "of" should be deleted;
Line 18, "under" should read -- produced under --;
Line 23, "above" should read -- above, --;
Line 25, "even" should be deleted;
Line 27, "in the recent" should read -- including conventional --; and "apparatus" should read -- apparatuses --;
Line 28, "the" should be deleted;
Line 30, "best-suited" should read -- that is well-suited --;
Line 31, "global-environment harmless," should read -- harmless to the global environment, --;
Line 32, "consuming" should read -- consuming in an --;
Line 36, "the" should read -- an --;
Line 37, "the" should read -- a --;
Line 41, "the problems of the fusion" should read -- fusion problems or the like. --
Line 45, "the" should be deleted;
Line 46, "fusion of toner even in" should read -- toner fusion, even with --;
Line 61, "kgf/mm$^2$" should read -- kgf/mm$^2$, --.

UNITED STATES PATENT AND TRADEMARK OFFICE

CERTIFICATE OF CORRECTION

PATENT NO. : 6,001,521 
DATED : December 14, 1999
INVENTOR(S) : Junichiro Hashizume et al.

It is certified that error appears in the above-identified patent and that said Letters Patent is hereby corrected as shown below:

Column 4,
Line 4, "mN" should read -- mN, -- (second occurrence);
Line 24, "without" should read -- without-the --;
Line 25, "the fusion" should read -- fusion --;
Line 28, "the so-called" should be deleted;
Line 30, "a" should be deleted;
Line 35, "from the recent requirements of energy saving." should read -- to comply with recent energy saving requirements --;
Lines 37 and 49, "the" should deleted;
Line 42, "resulted in also" should read -- also resulted in --;
Line 44, "the stripe" should read -- a striped --;
Line 46, "image and" should read -- image, --;
Line 47, "image." should read -- image quality. --;
Line 53, "stripe" should read -- striped --;
Line 56, "the" should deleted (first occurrence);
Line 57, "of" should read -- of the --;
Line 59, "etc." should read -- etc., --;
Line 62, "hardness" should read -- hardness, --;
Line 64, "and therefore that it is" should read -- therefore making it --.

Column 5,
Line 1, "the fusion occurs" should read -- fusion occurs --;
Lines 3, 9, 19 and 36, "stripe" should read -- striped --;
Line 8, "the fusion" should read -- fusion --;
Line 12 , "kgf /$mm_2$" should read -- kgf /$mm_2$, --;
Line 32, "the" should read -- an --;
Line 34, "and in turn" should read -- and, in turn, --;
Line 40, "the" should be deleted;
Line 44, "such" should read -- such a --;
Line 46, "conditions, but such" should read -- conditions. Such a --;
Lines 47 and 48, "only" should be deleted;
Line 49, "film, but measures also" should read -- film. Such tests also measure --;
Line 53, "also" should be deleted;
Line 59, "defined" should read -- defined, --;
Line 64, "apparatus, or" should read -- apparatus. Alternatively, --.

UNITED STATES PATENT AND TRADEMARK OFFICE

CERTIFICATE OF CORRECTION

PATENT NO. : 6,001,521
DATED : December 14, 1999
INVENTOR(S) : Junichiro Hashizume et al.

It is certified that error appears in the above-identified patent and that said Letters Patent is hereby corrected as shown below:

Column 6,
Line 1, "apparatus, and that the" should read -- apparatus. The --;
Line 10, "a-G:H" should read -- a-C:H --;
Line 23, "even" should be deleted;
Line 24, "the" should be deleted;
Lines 27 and 39, "stripe" should read -- striped --;
Line 28, "test to sometimes pose" should read -- test, thereby posing --;
Line 31, "the fusion of toner" should read -- toner fusion --;
Line 32, "occurred" should read --occurred, --;
Line 40, "test to sometimes pose" should read -- test, thereby posing --;
Line 43, "the fusion of toner sometimes occurred," should read -- toner fusion sometimes occurred, --;
Line 64, "narrower" should read -- narrower, --;
Line 66, "lowered" should read -- lowered, --;
Line 67, "easier" should read -- more likely --; and "preferably" should read -- preferred --.

Column 7,
Line 2, "eV" should read -- eV, --;
Lines 6 and 8, "the", should be deleted;
Line 19, "as" should be deleted;
Line 20, "etc. as" should read -- etc., as the --;
Line 22, "atoms" should read -- atoms, as the --;
Line 30, "in" should read -- to be in --;
Line 41, "in not occurred." should read -- does not occur. --.

Column 8,
Line 27, "It is needless to mention that the" should read -- The --;
Line 32, "in" should read -- to be in --;
Line 45, "501", should read -- 501, --;
Line 47, "ground" should read -- ground, --;
Line 65, "closed" should read -- closed, --.

UNITED STATES PATENT AND TRADEMARK OFFICE

CERTIFICATE OF CORRECTION

PATENT NO. : 6,001,521
DATED : December 14, 1999
INVENTOR(S) : Junichiro Hashizume et al.

It is certified that error appears in the above-identified patent and that said Letters Patent is hereby corrected as shown below:

Column 9,
Lines 3 and 22, "example" should read -- example, --;
Line 14, "opened" should read -- opened, --;
Line 16, "505 as also" should read -- 505, thereby --;
Lines 18, 30 and 33, "gage" should read -- gauge --;
Line 40, "power and" should read -- power, and --;
Line 54, "layer" should read -- the layer --;
Line 61, "gas of hydrocarbon" should read -- hydrocarbon gas --.

Column 10,
Lines 2, "gage" should read -- guage --;
Line 5, "desired power" should read -- desired power, --;
Line 14, "is formed" should be -- delected --;
Line 20, "layer" should read -- the layer --;
Line 22, "hardness" should read -- hardness, --;
Line 24, "115°" should read -- 115°, --;
Line 41, "embodiment" should read -- embodiment, --;
Line 56, "gage" should read -- gauge --;
Line 60, "5" should read -- 5, --;
Line 61, "different" should read -- different, --.

Column 11,
Line 9, "totally" should be deleted;
Line 49, "ultraviolet-near infrared" should read -- ultraviolet-near-infrared --.

Column 12,
Line 1, "half" should read -- half, --;
Line 3, "the fusion was easy" should read -- fusion is likely --;
Line 6, "images," should read -- images --;
Line 9, "follows." should read -- follows: --;
Lines 23 and 25, "stripe" should read -- striped --;
Line 52, "on" should read -- the --;
Line 63, "filter was" should read -- filter --;
Line 64, "used." should be deleted.

UNITED STATES PATENT AND TRADEMARK OFFICE

CERTIFICATE OF CORRECTION

PATENT NO. : 6,001,521
DATED : December 14, 1999
INVENTOR(S) : Junichiro Hashizume et al.

It is certified that error appears in the above-identified patent and that said Letters Patent is hereby corrected as shown below:

Column 13,
Line 2, "follows." should read -- follows: --;
Line 10, "substrate" should read -- substrates --;
Line 15, "totally" should be deleted;
Line 40, "the" should be deleted;
Line 43, "photography" should read -- photography, --;
Line 67, "substrate" should read -- substrates --.

Column 14,
Line 5, "totally" should be deleted.

Column 15,
Line 1, "totally" should be deleted.

Column 16,
Line 29, "stripe shaving occurred" should read -- striped shaving occurred, --;
Line 60, "totally" should be deleted.

Column 17,
Line 66, "totally" should be deleted.

Column 18,
Line 24, "occurred and the" should read -- occurred, and --;
Line 26, "electrophotography" should read -- electrophotography, --;
Line 56, "totally" should be deleted.

Column 19,
Line 56, "totally" should be deleted.

UNITED STATES PATENT AND TRADEMARK OFFICE

CERTIFICATE OF CORRECTION

PATENT NO. : 6,001,521
DATED : December 14, 1999
INVENTOR(S) : Junichiro Hashizume et al.

It is certified that error appears in the above-identified patent and that said Letters Patent is hereby corrected as shown below:

Column 21,
Line 25, "stripe" should read -- striped --;
Line 26, "occurred" should read -- occurred, --;
Line 31, "hydrogen" should read -- hydrogen, --;
Lines 35 and 53, "the fusion of" should read -- toner fusion --;
Lines 36 and 54, "toner" should be deleted;

Column 22,
Line 14, "Index" should read -- index --.

Signed and Sealed this

Thirtieth Day of July, 2002

*Attest:*

*Attesting Officer*

JAMES E. ROGAN
*Director of the United States Patent and Trademark Office*